United States Patent [19]

Sasaki

[11] Patent Number: 4,468,133

[45] Date of Patent: Aug. 28, 1984

[54] ELECTRONIC TIMEPIECE

[75] Inventor: Seiko Sasaki, Tokyo, Japan

[73] Assignee: Seiko Instruments & Electronics Ltd., Tokyo, Japan

[21] Appl. No.: 575,485

[22] Filed: Jan. 31, 1984

Related U.S. Application Data

[63] Continuation of Ser. No. 399,747, Jul. 19, 1982, abandoned, which is a continuation of Ser. No. 75,893, Sep. 17, 1979, abandoned, which is a continuation-in-part of Ser. No. 927,363, Jul. 24, 1978, abandoned.

[30] Foreign Application Priority Data

Aug. 4, 1977 [JP] Japan ..... 52-93665

[51] Int. Cl.[3] ..... G04F 5/00

[52] U.S. Cl. ..... 368/156

[58] Field of Search ..... 368/10, 28, 30, 82–84, 368/85–87, 155–157, 187, 189; 364/705, 710

[56] References Cited

U.S. PATENT DOCUMENTS

| | | | |
|---|---|---|---|
| 3,988,886 | 1/1976 | Kashio | 318/189 |
| 4,003,409 | 12/1977 | Bayliss | 368/155 |
| 4,092,819 | 6/1978 | Takase | 368/85 |
| 4,125,993 | 11/1978 | Emile | 368/85 |
| 4,158,285 | 6/1979 | Heinsen et al. | 368/82 |

*Primary Examiner*—Vit W. Miska

*Attorney, Agent, or Firm*—Robert E. Burns; Emmanuel J. Lobato; Bruce L. Adams

[57] ABSTRACT

An electronic timepiece has a reference signal generator for generating a 1/10 seconds reference signal which is fed to a static counter which counts the 1/10 seconds reference signal and produces a reference count signal. A read only memory stores a system program which executes and controls a time count. An arithmetic and logic unit executes the time count and a random access memory stores the time counting data. A bidirectional data bus line is connected between the random access memory and the static counter, and a decoder is connected to the bidirectional data bus line for decoding the contents of both the random access memory and the static counter and providing corresponding decoded time data signals. A display device responds to the decoded time data signals and indicates the contents of the random access memory and the static counter. A control circuit is connected to the read only memory and coacts therewith to initiate the actions of the randon access memory and the arithmetic and logic unit in response to the reference count signal from the static counter.

4 Claims, 4 Drawing Figures

ELECTRONIC TIMEPIECE

This is a continuation, of application Ser. No. 399,747, filed July 19, 1982 which was a continuation application of Ser. No. 75,893 filed Sept. 17, 1979 which, in turn, was a continuation-in-part application of Ser. No. 927,363 filed July 24, 1978, all of which are now abandoned.

BACKGROUND OF THE INVENTION

1. Field of the Invention

This invention relates to an electronic timepiece and more particularly to a multifunction digital electronic timepiece wherein at least one part of the time counting function system comprises a static counter and wherein the time counting action and multifunction action are executed in another part which includes a read only memory, referred to as ROM, and a random access memory, referred to as RAM.

Recently, with advancements made in electronic technology, electronic timepieces, especially digital electronic timepieces, have become increasingly more popular on the market. Today, a multifunction digital timepiece, a world timepiece, and a timepiece having a calculator are available.

In order to commercially market these new types of timepieces, it is necessary to speed up and be flexible with respect to product planning, circuit design and the manufacture of ICs.

2. Description of the Prior Art

In consideration of the above aspects, it is desirable that a one chip IC be capable of performing a plurality of functions. Such an IC may include a time counter which has cascade-connected static type counter and a counter for a stop watch connected therewith such as described in U.S. Pat. No. 3,757,509 or a counter for an alarm.

As another example, a shift register can be used in place of the above mentioned counter as disclosed in U.S. Pat. No. 3,988,886. In the former case, although the counter exhibits low power dissipation by using a static counter, the area occupied by the IC chip is apt to be large.

In the latter case, which is referred to as the dynamic type system, the area occupied by the IC chip tends to be small but the current consumption is apt to increase. Moreover, with respect to the speed up and flexibility of the circuit design and IC manufacture, the former and latter cases are both undesirable. In order to eliminate the above defects, an integrated watch having a random access memory combined with a programmable logic array is under development such as described, for example, in U.S. Pat. No. 4,063,409.

However, such an integrated watch is disadvantageous because it has high current consumption since the circuit acts as high speed in response to a high frequency signal in the case of displaying (1/10) seconds, and (1/100) seconds.

SUMMARY OF THE INVENTION

An object of the invention is to provide an electronic timepiece which effectively eliminates the above defects. Another object of the invention is to provide an electronic timepiece having one part including a static counter which counts (1/100) seconds and (1/10) seconds and another part including ROM and RAM which count the other time and operate the multifunctions except for the time count. Still a further object of this invention is to provide an electronic timepiece in which the area occupied by the IC chip decreases and in which the power consumption of the IC decreases. Still other objects and advantages of the invention will become obvious and apparent from a reading of the specification and the drawings.

DETAILED DESCRIPTION OF PREFERRED EMBODIMENTS

Figure 1:
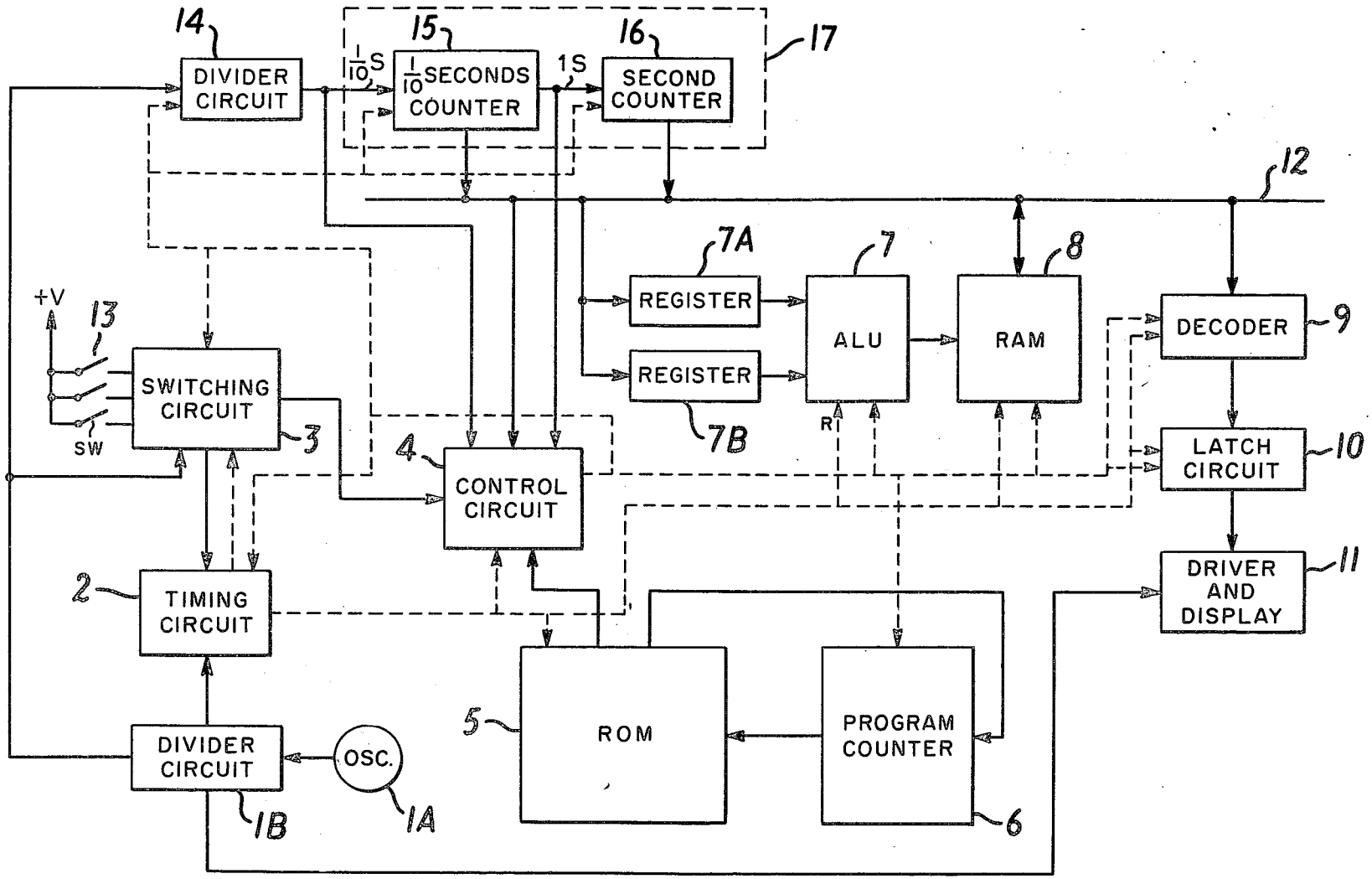
FIG. 1 is a block diagram of an electronic timepiece according to this invention.

FIG. 1 is a block diagram showing an embodiment of an electronic timepiece.

The reference numeral 1A depicts an oscillator circuit and the reference numeral 1B depicts a first divider circuit.

The divided output signal derived from the first divider circuit 1B is fed to a timing circuit 2, a switching circuit 3, a driver and display device 11 and a second divider circuit 14.

The timing circuit 2 receives the signals from the first divider circuit 1B, the switching circuit 3 and a control circuit 4 so that the timing circuit 2 generates the timing pulses. The timing pulses are input to the switching circuit 3, the control circuit 4, a ROM5, an arithemetic and logic unit 7 (hereinafter referred to as ALU7), a RAM8, a decoder 9 and a latch circuit 10 respectively.

The switching circuit 3 receives a signal from switch members 13 which are connected at one side to the power source, the output signal from the first divider circuit 1B and the control signal from the control circuit 4. The switching circuit 3 provides output signals to the control circuit 4 and the timing circuit 2 by converting the switching action of the switch members 13 to corresponding switching signals.

The control circuit 4 receives the signals from the ROM5 and a bidirectional data bus line 12, the signals from the switching circuit 3 and timing circuit 2, and further (1/10) seconds signal and one second signal. The control circuit 4 provides control signals to the timing circuit 2, the switching circuit 3, the ALU7, the RAM8, the decoder 9, the latch circuit 10, the program counter 6, the second divider circuit 14, the (1/10) seconds counter and the second counter respectively.

The program counter 6 receives the present address signal from the ROM5 and the jump signal or branch signal of the control circuit 4. And the program counter 6 produces the address signal added "+1" to the present address signal in case the next address signal is not the jump singal or the branch control signal. The program counter 6 also produces the jump address signal or the branch address signal in case the next address signal is the jump signal or the branch control signal.

The ALU7 receives the data signal from the bidirectional data bus line 12 through the registers 7A and 7B and the ALU7 performs the addition, the substraction, the data conversion, the data comparison, etc. in response to the operation command signal from the control circuit 4. The result of the operation of the ALU7 is stored in the RAM8.

The RAM8 stores the time counting data, the date for flag memory which executes the system operation, receives the control signal from the control circuit 4, outputs to the bidirectional data bus line 12, and reads the content of the bidirectional data bus line 12 directly.

The decoder 9 decodes the data on the bidirectional data bus line 12 into the figure and the mark or the like in response to the signal from the control circuit 4. The output of the decoder 9 transfers to the latch circuit 10.

The latch circuit 10 reads the output of the decoder 9 in synchronism with the signal from the control circuit 4 so that the driver and display device 11 receives the output signal of the latch circuit 10. On the other hand, the second divider circuit 14 input the output signal of the divider circuit 1B and the control signal of the control circuit 4 and produces the (1/10) seconds signal which is fed to a (1/10) seconds counter 15 which also receives the control signal from the control circuit 4. The carry signal of the (1/10) seconds counter 15 is fed to a second counter 16. The counting output of the (1/10) seconds counter 15 is applied to the bidirectional data bus line 12. The second counter 16 receives the carry signal from the (1/10) seconds counter 15 and the control signal from the control circuit 4. The counting output of the second counter 16 is also applied to the bidirectional data bus line 12. A resettable static counter 17 is comprised of the counters 15 and 16 and the static counter has outputs connected to the bidirectional data bus line 12. The operation of the above mentioned construction will now be described.

The program for effecting or controlling the time count and display function, the multifunction except the time counting function, the alarm function, the stopwatch function, the timer function, etc. is stored in the ROM5.

The data of the ROM5 designated by the program counter 6 is read out in order by the program. The output of the ROM5 is input to the control circuit 4 and the control circuit 4 interprets the data from the ROM5 and produces the control signal to each section whereby the action of the watch and the other functions are executed.

Referring now to the time counting and display action of the stopwatch, the system is energized by the (1/10) seconds signal since the control circuit 4 receives the (1/10) seconds signal in case of the stopwatch mode whereby "(1/10) seconds" unit data in the area for the stopwatch stored in the RAM8 is provided to the bidirectional data bus line 12. At the same time, the data of the bidirectional data bus line is set in the register 7A. Also, "1" data is set in the register 7B and the addition command "ADD" from the ROM5 is applied to the control 4 so that the addition command "ADD" is interpreted for a variety of control commands.

Consequently, the addition function is executed in the ALU7. Namely, the data of "(1/10) seconds" unit for the stopwatch is added "1" and the resulting value is stored again in the RAM8.

Next, the carry judgement is executed in the ALU7 whether or not the above resulting value which is the content of "(1/10) seconds" unit is above "10".

In case the content of the "(1/10) seconds" unit is "10" or below, the other counting operations such as minutes and hours are not executed but the program makes progress to the display flow.

In case the content of "(1/10) seconds" unit is above "10", the content of "(1/10) seconds" unit is reset to "0"and further "1" is added to the content of the "second" unit. In the same manner, the program makes progress in the other units such as "second" unit and "minute" unit. If the counting flow comes to an end, the program makes progress to the display flow for displaying the counting result.

Figure 2:
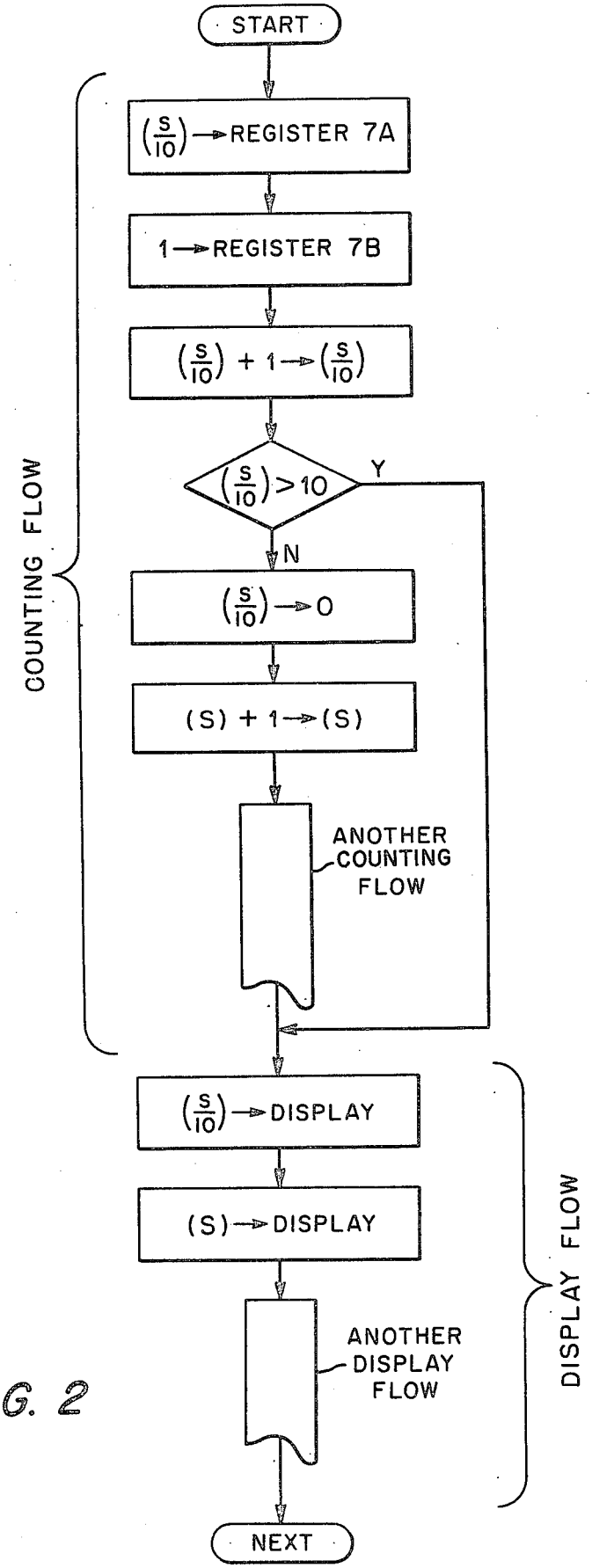
FIG. 2 is a flow chart of a program according to this invention.

FIG. 2 is the flow chart of the the above program. As mentioned above, according to this invention, the part including the ROM5 and the RAM8 executes the control of the alarm function, the stopwatch function, the calculating function, the timer function, the switch operation function, the display function and the time correction.

Accordingly, in case the modification and addition of the operation of the electronic timepiece or the modification of the display function is required, these are carried into execution readily by the program modification of the ROM5 or the data allocation-modification of the RAM8.

For example, it is possible that the program modification of the ROM5 is executed by a mask change of the ROM5 during the fabricating step of the IC since the modification of the ROM5 in this manner is treated as software. Thus the fabricated IC chip becomes an IC which may be programmed upon connecting the additional terminals to the IC chip by user. And further, the region including the RAM8 is possible to be modified if the RAM8 is designed with a large memory size in advance. The normal operation of the timepiece function will now be described.

The normal timepiece has the reference signal which is the (1/10) seconds signal derived from the second divider circuit 14, and the reference signal is fed to the (1/10) seconds counter 15. The present system, including the electronic timepiece function is actuated when the one second signal 1S from the static counter 17 is input to the control circuit 4 in the form of a reference count signal. The time data which are counted by the (1/10) seconds counter 15 and the second counter 16 are transferred to the bidirectional data bus line 12 with the control signal derived from the control circuit 4, and at the same time the time data, are fed to the latch circuit 10 through the decoder 9 whereby the time data are displayed during the predetermined time.

Further, the time counting action except the (1/10) seconds counter and the second counter, for example, "10 seconds" unit, "minute" unit, "10 minutes" unit, "hour" unit, "10 hours" unit etc. is executed in the ALU7 and the RAM8, according to the program stored by the ROM5. The carry-judgement of the "second" unit to "10 seconds" unit is executed in view of the counting content of the second counter 16. If the content of the second counter is "9", "1" is added to "10 seconds" unit of the RAM8 and the result of the addition is stored again in the "10 seconds" unit of the RAM8 when the system is actuated with the next timing. With respect to another upper unit, the normal operation of the electronic timepiece is executed in the above operation manner.

Each of the counters 15 and 16 is composed of 4 bits and the counting content of each counter is output in a time shared manner to the bidirectional bus line 12.

The time indication of the upper unit more than the "second" unit is executed by the program stored in the ROM5 in the same manner as the time count.

Figure 3A:
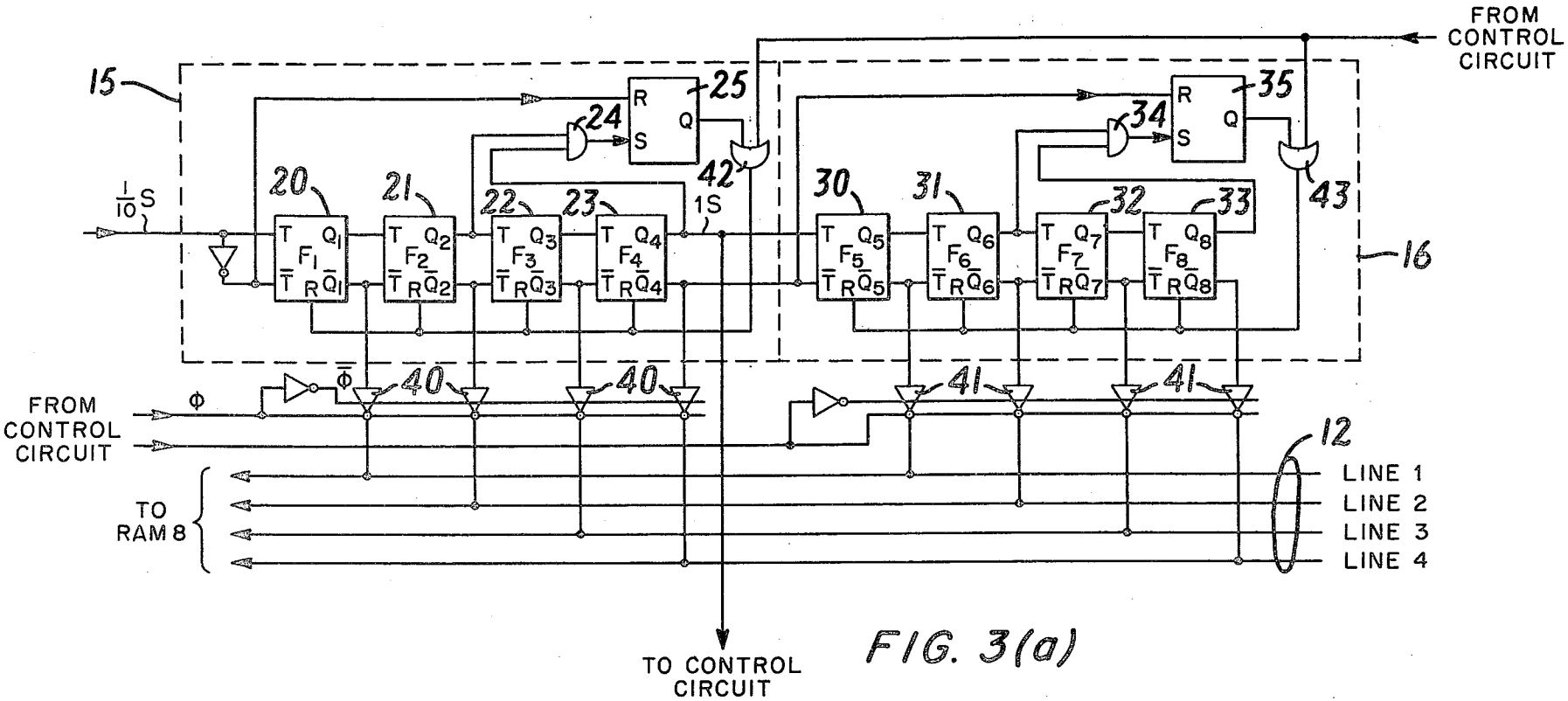
FIG. 3(*a*) is a circuit diagram including (1/10) seconds counter, second counter and bidirectional data bus line and FIG. 3(*b*) is a circuit diagram of the inverters shown schematically in FIG. 3(*a*).
Figure 3B:
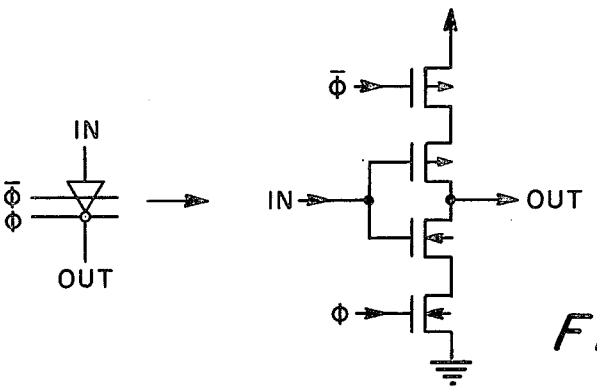

FIG. 3(*a*) is a detailed embodiment of the (1/10) seconds counter 15, the second counter 16 and a portion of the bidirectional data bus line 12.

The (1/10) seconds counter 15 and the second counter 16 are composed of flipflop groups (hereinafter referred to as T·F/F) 20–23 and 30–33 which act as a 10-counter. The AND gates 24 and 34 are carry detection gates of the T·F/F group 20–23 and the T·F/F group 30–33.

The set-reset flipflops 25 and 36 are set so that the T·F/F groups are reset when the counting contents reach to "10". Consequently, the T·F/F groups initiate to count from "0" again. The set-reset flipflops 25 and 35 are reset respectively when the input pulse (for example, the (1/10) seconds signal or the second signal) changes from the high level state to the low level state.

The output $\overline{Q}$ of the each T·F/F is connected to gates of the clocked inverters 40 and 41 which are shown in FIG. 3(*b*).

The output terminals of the clocked inverters 40 and 41 are connected to the bidirectional data bus line 12. The control input of the clocked inverter 40 connected to the output terminal of the (1/10) second counter 15 is the control signal from the control circuit 4 and the counting content of the (1/10) seconds counter 15 is transferred to the bidirectional data bus line 12 including lines 1, 2, 3 and 4 by the control signal of the control circuit 4. At the same time, the counting content is stored in the RAM8.

In the same manner, although the counting content of the second counter 16 is transferred to the bidirectional data bus line 12 through the clocked inverter, it is controlled by the control signal of the control circuit 4 in the above mentioned manner.

Namely, a one second signal 1S is produced by the (1/10) seconds counter 15 and at the same time the system initiates operation. At the same time, the clocked inverter 41 shift to the ON state whereby the counting content is transferred to the bidirectional data bus line 12 and is displayed by the driver and display device 11 through the decoder. 9.

Next, in case the present system has an alarm function, the content of the second counter 16 is accumulated in the RAM8. The coincidence between this content and time data more than "second" unit, and the memory for the alarm timepiece stored by the RAM8 in advance, is detected according to the program in the ROM5 whereby the alarm is produced In the time correction, the time correction of "10 seconds" unit and over is executed by the program and the time correction of the "(1/10) seconds" unit and the "second" unit is executed by the reset action. This reset action is executed by the exterior switch member whose operation provides the output signal of the switching circuit 3 to the control circuit 4.

The time correct signal from the control circuit 4 is provided to the flipflop group 20–23 and the flipflop group 30–33 through the OR gates 42 and 43. As described above, an electronic timepiece according to this invention comprises a part for counting "second" unit and below, and a part including the ROM and the RAM which executes the counting action of "10 seconds" unit and over, and the multifunction actions except the timepiece function.

The former part is composed of the static counter. The power dissipation is decreased because the time period at which the ROM and RAM count the normal time action is one second.

The number of the step actions of the ROM for the operational control may be decreased because the count of the "(1/10) seconds" unit and "second" unit is executed by the static counter. And also it is advantageous that the modification of the electronic timepiece function is executed by the program.

What is claimed is:

1. In an electronic timepiece: reference signal generating means for generating a 1/10 seconds reference signal; a static counter connected to said reference signal generating means for counting at least the 1/10 seconds reference signal and producing a reference count signal; a read only memory for storing a system program which executes and controls a time count; an arithmetic and logic unit for executing the time count; a random access memory connected to said arithmetic and logic unit for storing time counting data; a bidirectional data bus line connected between said random access memory and said static counter; a decoder connected to said bidirectional data bus line for decoding the contents of said random access memory and said static counter and providing corresponding decoded time data signals; display means responsive to the decoded time data signals for indicating the contents of said random access memory and said static counter; and control means connected to said read only memory and coacting therewith for initiating the actions of said random access memory and said arithmetic and logic unit in response to the reference count signal from said static counter.

2. An electronic timepiece according to claim 1; wherein said static counter includes a 1/10 seconds counter for counting the 1/10 seconds reference signal and a second counter for counting a one second signal.

3. An electronic timepiece according to claim; 1; wherein said static counter includes means for producing a one second reference count signal.

4. An electronic timepiece according to claim 1; including an exteriorly actuated switch member operable when actuated to reset said static counter.

* * * * *